US011518161B2

(12) United States Patent
Meng et al.

(10) Patent No.: US 11,518,161 B2
(45) Date of Patent: Dec. 6, 2022

(54) BEER BARREL PRINTING EQUIPMENT

(71) Applicant: Ningbo Major Draft Beer Equipment Co., Ltd., Ningbo (CN)

(72) Inventors: Fandong Meng, Ningbo (CN); Bangcai Luo, Ningbo (CN)

(73) Assignee: Ningbo Major Draft Beer Equipment Co., Ltd., Ningbo (CN)

( * ) Notice: Subject to any disclaimer, the term of this patent is extended or adjusted under 35 U.S.C. 154(b) by 0 days.

(21) Appl. No.: 17/506,603

(22) Filed: Oct. 20, 2021

(65) Prior Publication Data

US 2022/0266588 A1 Aug. 25, 2022

(30) Foreign Application Priority Data

Feb. 25, 2021 (CN) ..... 202110214880.2
Feb. 25, 2021 (CN) ..... 202120421097.9

(51) Int. Cl.
*B41F 17/00* (2006.01)
*B41F 17/18* (2006.01)

(52) U.S. Cl.
CPC ..... *B41F 17/18* (2013.01); *B41F 17/002* (2013.01); *B41P 2217/62* (2013.01)

(58) Field of Classification Search
CPC ..... B41F 17/02; B41F 17/002; B41F 17/008; B41F 17/18; B41F 17/20; B41F 17/22; B41F 13/004; B41K 3/32; B41K 3/36; B41K 3/44; B41M 5/0058; B41M 5/0082; B41M 1/40; B41P 2217/50; B41P 2217/53; B41P 2217/61; B41P 2217/62; B44B 5/0009; B44B 5/009; B44B 5/0014; B44B 5/022; B44B 5/0028
See application file for complete search history.

(56) References Cited

U.S. PATENT DOCUMENTS 10,086,601 B2 * 10/2018 Luo ..... B44B 5/0028
11,104,122 B2 * 8/2021 Luo ..... B41F 13/004

* cited by examiner

*Primary Examiner* — Matthew G Marini
*Assistant Examiner* — Marissa Ferguson-Samreth
(74) *Attorney, Agent, or Firm* — Wood, Phillips. Katz, Clark & Mortimer

(57) ABSTRACT

The present invention discloses beer barrel printing equipment, including a stand, a first matrix and a second matrix, a locating component, a first beer barrel printing device, and a second beer barrel printing device; a plurality of first matrix mounting positions and second matrix mounting positions are respectively arranged on the first beer barrel printing device and the second beer barrel printing device; the first beer barrel printing device and the second beer barrel printing device respectively control one of the first matrix mounting positions and one of the second matrix mounting positions to move; in a state that the locating member of the locating component is inserted into a tooth slot of the locating gear, the first beer barrel printing device is unable to control the first matrix mounting positions to move and/or the second printing device is unable to control the second matrix mounting positions to move.

10 Claims, 6 Drawing Sheets

BEER BARREL PRINTING EQUIPMENT

TECHNICAL FIELD

The present invention relates to the technical field of imprinting, and in particular to beer barrel printing equipment.

BACKGROUND ART

Beer barrels are commonly used containers for holding beer. In order to ensure the intensity of the beer barrels, and meanwhile reduce the weight and remove rust, the beer barrels are usually made of stainless steel and other materials. In order to facilitate identification, relevant identification information is usually printed on barrel bodies of the beer barrels; and the identification information is formed by extrusion of a convex mold on an inner side of the beer barrel and a concave mold on an outer side of the beer barrel. In the prior art, after the convex mold is aligned with a groove, the convex mold is driven to be close to the groove. However, in this process, the convex mold or the groove would possibly skew to affect a coining effect and even lead to coining failure, thereby resulting in waste of cost and time.

SUMMARY OF THE INVENTION

In order to overcome the deficiencies in the prior art, the present invention provides beer barrel printing equipment, which locks a first matrix and a second matrix so that the two do not skew in a get-close process, thus greatly enhancing a coining effect.

In order to achieve the foregoing objective, the present invention is implemented by using the following technical solution:

Beer barrel printing equipment includes a stand, a pushing device, matrix components, a locating component, a first beer barrel printing device mounted on the stand, and a second beer barrel printing device mounted on the stand.

A plurality of matrix components are arranged, and each of the matrix components includes a first matrix and a second matrix cooperating with each other to imprint a single character or pattern; and the first matrix and the second matrix are located on two sides of a machining station for beer barrel printing.

A plurality of first matrix mounting positions are distributed on the first beer barrel printing device; the first matrixes are mounted on the first matrix mounting positions; the first beer barrel printing device controls one of the first matrix mounting positions to move to the machining station for beer barrel printing.

A plurality of second matrix mounting positions are distributed on the second beer barrel printing device; the second matrixes are mounted on the second matrix mounting positions; the second beer barrel printing device controls one of the second matrix mounting positions to move to the machining station for beer barrel printing The locating component includes a locating gear, and a locating member matched with the locating gear; the locating member may be inserted into or separated from a tooth slot of the locating gear; in a state that the locating member is inserted into the tooth slot of the locating gear, the first beer barrel printing device is unable to control the first matrix mounting positions to move and/or the second printing device is unable to control the second matrix mounting positions to move.

The pushing device is configured to control the first matrixes and the second matrixes to be close to each other or away from each other.

By the adoption of the above structure, a position of the beer barrel that needs to be printed is placed at the machining station for beer barrel printing; according to the imprinting content, the first beer barrel printing device controls one of the first matrixes that needs to be used to move to one side of the machining station for beer barrel printing, and the second beer barrel printing device controls one of the second matrixes that needs to be used to move to the other side of the machining station for beer barrel printing; at this time, the locating member is inserted into the tooth slot of the locating gear, and if the first beer barrel is unable to control the first matrix mounting positions to move, i.e., locking of the first matrixes is realized, the used one of the first matrixes is effectively prevented from skewing in the residual printing process to affect the printing effect; and if the second beer barrel is unable to control the second matrix mounting positions to move, i.e., locking of the second matrixes is realized, the used one of the second matrixes is effectively prevented from skewing in the residual printing process to affect the printing effect.

The locating member being inserted into the tooth slot of the locating gear may also realize determining whether the used one of the first matrixes and/or second matrixes moves in place, i.e., whether the used one of the first matrixes and/or second matrixes directly faces the machining station for beer barrel printing; in some embodiments, when the locating member is inserted into the tooth slot of the locating gear, the locating member performs limiting adjustment on the locating gear to affect the adjustment of motion control of the first beer barrel printing device for the first matrix mounting positions and/or the motion control of the second beer barrel printing device for the second matrix mounting positions, so that the used one of the first matrixes and/or second matrixes directly faces the machining station for beer barrel printing to realize accurate locating.

The pushing device controls the first matrixes and the second matrixes to be close to each other to realize printing on the beer barrel. After imprinting of one character is completed, the pushing device drives the first matrixes and the second matrixes to be away from each other, and the locating member is separated from the tooth slot of the locating gear and reset.

In some embodiments, the first beer barrel printing device includes a corresponding first connecting frame along a linear direction; the first matrixes are arranged and distributed on the connecting frame; the first connecting frame may linearly move according to the imprinting content to cause one of the first matrixes that needs to be used to move to the machining station for beer barrel printing; in some embodiments, the second beer barrel printing device includes a corresponding second connecting frame along the linear direction; the second matrixes are arranged and distributed on the connecting frame; and the second connecting frame may linearly move according to the imprinting content to cause one of the second matrixes that needs to be used to move to the machining station for beer barrel printing.

Further, the locating gear includes a first locating gear and a second locating gear; the locating member includes a first locating member matched with the first locating gear, and a second locating member matched with the second locating gear.

In some embodiments, the first beer barrel printing device includes a first printing turntable capable of rotating axially; the first matrix mounting positions are distributed on an excircle surface of the first printing turntable; and in a state that the first locating member is inserted into the tooth slot of the first locating gear, the first printing turntable is unable to rotate.

In some embodiments, the second beer barrel printing device includes a second printing turntable capable of rotating axially; the second matrix mounting positions are distributed on an excircle surface of the second printing turntable; and in a state that the second locating member is inserted into the tooth slot of the second locating gear, the second printing turntable is unable to rotate.

By the adoption of the above structure, the first locating gear and the first locating member cooperate with each other to realize locking of the first printing turntable, so as to realize locking of the first matrixes; and the second locating gear and the second locating member cooperate with each other to realize locking of the second printing turntable, so as to realize locking of the second matrixes.

Further, the number of the first matrix mounting positions on the first printing turntable matches the number of the tooth slots of the first locating gear; and the number of the second matrix mounting positions on the second printing turntable matches the number of the tooth slots of the second locating gear.

By the adoption of the above structure, it is ensured that for any one of the first matrix mounting positions on the first printing turntable and any one of the second matrix mounting positions on the second printing turntable, when the first printing turntable and the second printing turntable rotate to the machining station for beer barrel printing respectively, the first locating member and the second locating member can be respectively inserted into the tooth slots of the first locating gear and the second locating gear.

Further, the number of the first matrix mounting positions on the first printing turntable is equal to the number of the tooth slots of the first locating gear; and the number of the second matrix mounting positions on the second printing turntable is equal to the number of the tooth slots of the second locating gear.

By the adoption of the above structure, the first matrix mounting positions on the first printing turntable are in one-to-one correspondence with the tooth slots of the first locating gear; and the second matrix mounting positions on the second printing turntable are in one-to-one correspondence with the tooth slots of the second locating gear.

Further, in some embodiments, the number of the first matrix mounting positions on the first printing turntable is not equal to the number of the tooth slots of the first locating gear, and a numerical relation between the first matrix mounting positions on the first printing turntable and the tooth slots of the first locating gear matches a rotation speed relation between the first printing turntable and the first locating gear; the number of the second matrix mounting positions on the second printing turntable is not equal to the number of the tooth slots of the second locating gear, and a numerical relation between the second matrix mounting positions on the second printing turntable and the tooth slots of the second locating gear matches a rotation speed relation between the second printing turntable and the second locating gear.

For example, a rotation speed ratio of the first locating gear to the first printing turntable is 2:1, i.e., when the first locating gear rotates one circle, the second printing turntable rotates two circles, so that the first matrix mounting positions on the first printing turntable are divided into pairs, and the two first matrix mounting positions in each pair are symmetrically distributed on two sides of the first printing turntable, while the number of the tooth slots of the first locating gear is equal to the number of pairs of first matrix mounting positions, i.e., one of the tooth slots of the first locating gear corresponds to one pair of first matrix mounting positions; during operation, when one first matrix mounting position from one pair of first matrix mounting positions rotates to the machining station for beer barrel printing, the first locating member is inserted into the corresponding tooth slot in the first locating gear; when the other first matrix mounting position from this pair of first matrix mounting positions rotates to the machining station for beer barrel printing, i.e., when the first printing turntable rotates half a circle, the first locating gear rotates one circle at this time, and the first locating member is just still inserted into the original tooth slot.

Further, the pushing device includes a pushing driving member mounted on the stand, and the pushing driving member acts on the second beer barrel printing device and drives the second beer barrel printing device to be close to or away from the first beer barrel printing device.

The stand is provided with first guide rails on two sides with the second beer barrel printing device; correspondingly, two sides of the second beer barrel printing device facing the first guide rails are correspondingly provided with first moving members matched with the first guide rails, and the second beer barrel printing device is slidably mounted on the stand by means of the first moving members and the first guide rails.

By the adoption of the above structure, after the used pair of first matrix and second matrix is positioned, an inner wall of the position of the beer barrel that needs to be printed is attached to the first matrix, and the pushing driving member drives the second beer barrel printing device to be close to the first beer barrel printing device to cause the second matrix to be attached to an outer wall of the position of the beer barrel that needs to be printed to realize coining; and after the imprinting of one character is completed, the pushing driving member drives the second beer barrel printing device to be away from the first beer barrel printing device.

The pushing driving member is a pushing hydraulic cylinder.

Further, the first beer barrel printing device includes a first servo motor, and a first mounting frame configured to mount the first printing turntable; the first mounting frame is connected with the stand; the first printing turntable is convexly provided with a first rotating shaft at an axis thereof; the first printing turntable is rotatably mounted on the first mounting frame through the first rotating shaft; the first locating gear is mounted on the first rotating shaft; and the first servo motor drives the first printing turntable and the first locating gear to synchronously rotate around an axis of the first rotating shaft.

By the adoption of the above structure, the first servo motor drives the first printing turntable to control the position to realize initial locating of the first printing turntable, i.e., realize rotating one first matrix that needs to be used from the first matrixes distributed on the first printing turntable to the position of the beer barrel that needs to be printed.

The synchronous rotation of the first printing turntable and the first locating gear can be understood as that the rotating speeds of the two are equal.

Specifically, one side of the first printing turntable is convexly provided with the first rotating shaft; one side of the first locating gear is convexly provided with a motor connecting portion for driving connection with the first servo motor at a rotating shaft of the first locating gear; and the other side of the first locating gear is connected with the first rotating shaft.

A bearing is arranged between the first rotating shaft and the first mounting frame.

Further, the second beer barrel printing device includes a second servo motor, and a second mounting frame configured to mount the second printing turntable; the second mounting frame is connected with the stand; the second printing turntable is convexly provided with a second rotating shaft at an axis thereof; the second printing turntable is rotatably mounted on the second mounting frame through the second rotating shaft; the second locating gear is mounted on the second rotating shaft; and the second servo motor drives the second printing turntable and the second locating gear to synchronously rotate around an axis of the second rotating shaft.

By the adoption of the above structure, the second servo motor drives the second printing turntable to control the position to realize initial locating of the second printing turntable, i.e., realize rotating one second matrix that needs to be used from the second matrixes distributed on the second printing turntable to the position of the beer barrel that needs to be printed.

The synchronous rotation of the second printing turntable and the second locating gear can be understood as that the rotating speeds of the two are equal.

Specifically, two sides of the second printing turntable are convexly provided with second rotating shafts; an output shaft of the second servo motor is in driving connection with the second rotating shaft on one side of the second printing turntable; and the second locating gear is mounted on the second rotating shaft on the other side of the second printing turntable.

Bearings are arranged between the second rotating shafts and the second mounting frame.

The pushing device is connected with the second mounting frame, and the first moving members are mounted on the second mounting frame.

Further, the locating component includes a locating moving member configured to mount the locating member, a locating guide rail configured to guide the locating moving member, and a locating driving member configured to drive the locating moving member; and the locating driving member drives the locating moving member to slide along the locating guide rail.

Specifically, the locating moving member includes a first locating moving member and a second locating moving member; the locating guide rail includes a first locating guide rail and a second locating guide rail; and the locating driving member includes a first locating driving member and a second locating driving member.

The first locating member is mounted on the first locating moving member, and the first locating driving member drives the first locating moving member to slide along the first locating guide rail.

The first locating guide rail and the first locating driving member are mounted on the first mounting frame.

The first locating driving member and the first locating member are located on two sides of the first locating moving member; and the shape of one end of the first locating member inserted into the tooth slot of the first locating gear matches the shape of the tooth slot of the first locating gear.

The second locating member is mounted on the second locating moving member, and the second locating driving member drives the second locating moving member to slide along the second locating guide rail.

The second locating guide rail and the second locating driving member are mounted on the second mounting frame.

The second locating driving member and the second locating member are located on two sides of the second locating moving member; and the shape of one end of the second locating member inserted into the tooth slot of the second locating gear matches the shape of the tooth slot of the second locating gear.

Further, the beer barrel printing equipment includes a beer barrel driving device. The beer barrel driving device includes a beer barrel rotation component configured to drive the beer barrel to axially rotate.

In actual production, a string of characters need to be imprinted on a side wall of the beer barrel. By the adoption of the above structure, after the imprinting of one character is completed, the beer barrel driving device rotates the beer barrel to cause a next position of the beer barrel that needs to be printed to rotate to the machining station for beer barrel printing for imprinting.

Further, the beer barrel driving device further includes a first translation component and a second translation component configured to drive the beer barrel rotation component to be close to or away from one side provided with the first beer barrel printing device and the second beer barrel printing device, and a lifting component configured to drive the beer barrel rotation component to rise and fall.

By the adoption of the above structure, the first translation component is configured to realize that the beer barrel to be machined fast gets close to or away from the first beer barrel printing device and the second beer barrel printing device to realize initial locating of the beer barrel, and the second translation component is configured to realize accurate locating of the beer barrel to be machined.

The lifting component is configured to drive an inner wall of the beer barrel to be machined to be attached to and separated from the second matrixes.

Further, the first translation component includes a first translation guide rail arranged on the stand, a first translation driving member and a first translation member; the first translation driving member drives the first translation member to translate along the first translation guide rail.

The lifting component includes a lifting driving member and a lifting plate; the lifting driving member is mounted on a second moving member, and the lifting driving member drives the lifting plate to rise and fall relative to the first moving members; the lifting component further includes a lifting guide slide rail arranged on the lifting plate along a lifting direction of the lifting plate, and a lifting guide slide block arranged on the second moving member along the lifting direction of the lifting plate; and the lifting guide slide rail matches with the lifting guide slide block to slide.

The second translation component includes a second translation guide rail arranged on the lifting plate, a second translation driving member and a second translation member; the second translation driving member drives the second translation member to translate along the second translation guide rail; and the beer barrel rotation component is mounted on the second moving member.

Specifically, the first translation driving member and the lifting driving member adopt cylinders, and the second translation driving member adopts a screw rod.

Further, the beer barrel rotation component includes a clamping jaw mounting frame, a clamping jaw disc rotatably mounted on the clamping jaw mounting frame, and a clamping jaw disc driving member configured to drive the clamping jaw disc to rotate; and a plurality of clamping jaws configured to fix the beer barrel are mounted on the clamping jaw disc.

By the adoption of the above structure, the clamping jaws on the clamping jaw disc grasp the beer barrel, and the axis of the beer barrel is coaxial with the axis of the clamping jaw disc; the clamping jaw driving member drives the clamping jaw disc to rotate, and the beer barrel rotates with the rotation of the clamping jaw disc.

Specifically, the clamping jaw mounting frame is mounted on the second translation member; the clamping jaw disc is coaxially fixed with a clamping jaw disc drive gear; the clamping jaw disc driving member realizes rotation driving for the clamping jaw disc by means of the arrangement of a clamping jaw disc driven gear meshed with the clamping jaw disc drive gear.

Further, the clamping jaws may be slidably mounted on the clamping jaw disc close to or away from the center of the clamping jaw disc, and the beer barrel rotation component further includes a clamping jaw driving member configured to drive the clamping jaws to rotate.

By the adoption of the above structure, the clamping jaws firstly slide towards the center of the clamping jaw disc and extend into one end of the beer barrel; the clamping jaws then slide away from the center of the clamping jaw disc, so that the clamping jaws support the inner wall of one end of the beer barrel to realize connection between the beer barrel and the clamping jaws; and after all characters are imprinted, the clamping jaws slide towards the center of the clamping jaw disc, so that the clamping jaws are separated from the beer barrel.

Specifically, three clamping jaws are provided; clamping jaw guide rails matched with the clamping jaws are arranged on the clamping jaw disc; and the clamping jaws are slidably mounted on the clamping jaw guide rails.

The clamping jaw driving member is a telescopic member, a telescopic end of the telescopic member is provided with a clamping jaw action member; clamping jaw connecting members are arranged between the clamping jaw action member and the clamping jaws, and two ends of the clamping jaw connecting members are rotatably connected with the clamping jaws and the clamping jaw action member, respectively; and the clamping jaw driving member is a telescopic cylinder.

By the adoption of the above structure, when the clamping jaw driving member extends and retracts to drive the clamping jaw action member to be close to a plane where the clamping jaws are located, the clamping jaw connecting members push the clamping jaws to slide away from the center of the clamping jaw disc; and when the clamping jaw driving member extends and retracts to drive the clamping jaw action member to be away from the plane where the clamping jaws are located, the clamping jaw connecting members pull the clamping jaws to slide towards the center of the clamping jaw disc.

The clamping jaw action member is mounted on the clamping jaw disc, and the clamping jaw action member is coaxial with the clamping jaw disc; rotating shafts are arranged between a telescopic rod of the clamping jaw driving member and the clamping jaw disc as well as the clamping jaw action member. In the above structure, the clamping jaw action member and the clamping jaw disc rotate together, and the clamping jaw driving member does not affect the clamping jaw disc and the clamping jaw action member when driving the clamping jaw action member to be close to or away from the mounting plane of the clamping jaws.

Further, the beer barrel rotation component includes supporting seats; rotary rollers are mounted on the supporting seats; two supporting seats are arranged, and two rotary rollers are symmetrically arranged on each of the supporting seats.

By the adoption of the above structure, the rotary rollers are in contact with an outer wall of the beer barrel to support the beer barrel and reduce friction therebetween. Specifically, the supporting plates are slidably mounted on the second translation guide rail; one of the supporting seats close to the second translation member is connected with the second translation member; and the two supporting seats are connected through a connecting rod.

Further, the first matrixes are located on the inner side of a side wall of the beer barrel to be machined, and the second matrixes are located on the outer side of the side wall of the beer barrel to be machined; the first matrixes are convex molds; and correspondingly, the second matrixes are concave molds.

Further, the first matrix mounting positions and the second matrix mounting positions are provided with mounting slots; and the first matrixes and the second matrixes are respectively clamped in the mounting slots in the first matrix mounting positions and the second matrix mounting positions in a matching manner. Specifically, the mounting slots are dovetail slots.

Compared with the prior art, the present invention has the following beneficial effects:

(1) The beer barrel printing equipment of the present invention realizes locking of the first matrixes and/or the second matrixes by means of inserting the locating member into the tooth slot of the locating gear, so that the first matrixes and/or the second matrixes would not skew in the get-close process, and the coining effect is greatly enhanced.

(2) According to the beer barrel printing equipment of the present invention, both the first beer barrel printing device and the second beer barrel printing device adopt the first printing turntable and the second printing turntable to realize control of the first matrixes and the second matrixes, so that the space occupied by the beer barrel printing equipment can be reduced.

(3) The beer barrel printing equipment of the present invention is reasonable in structural design.

Figure 1:
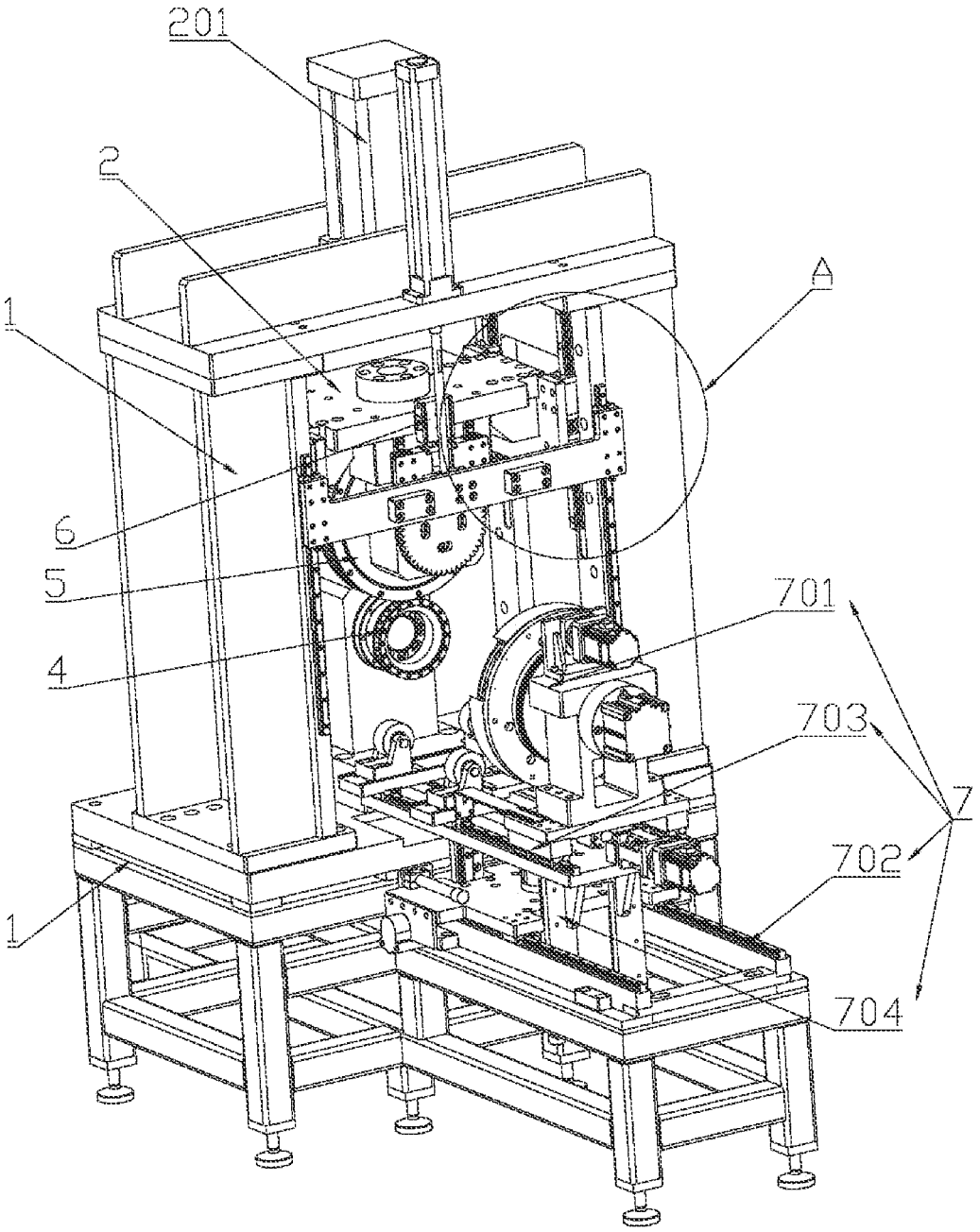
FIG. 1 is a three-dimensional schematic structural diagram of beer barrel printing equipment of the present invention.

Numerals in the drawings: 1: stand; 2: pushing device; 201: pushing driving member; 202: first guide rail; 203: first moving member; 3: matrix component; 301: first matrix; 302: second matrix; 4: first beer barrel printing device; 401: first matrix mounting position; 402: first printing turntable; 4021: first rotating shaft; 403: first servo motor; 404: first mounting frame; 5: second beer barrel printing device; 501: second matrix mounting position; 502: second printing turntable; 5021: second rotating shaft; 503: second servo motor; 504: second mounting frame; 6: locating component; 601: locating gear; 6011: first locating gear; 6012: second locating gear; 602: locating member; 6021: first locating member; 6022: second locating member; 603: locating moving member; 6031: first locating moving member; 6032: second locating moving member, 604: locating guide rail; 6041: first locating guide rail; 6042: second locating guide rail; 605: locating driving member; 6051: first locating driving member; 6052: second locating driving member; 7: beer barrel driving device; 701: beer barrel rotation component; 7011: clamping jaw mounting frame; 7012: clamping jaw disc; 7013: clamping jaw disc driving member; 7014: clamping jaw; 7015: clamping jaw driving member; 7016: clamping jaw guide rail; 7017: clamping jaw action member; 7018: clamping jaw connecting member; 702: first translation component; 7021: first translation guide rail; 7022: first translation driving member; 7023: first translation member; 703: second translation component; 7031: second translation guide rail; 7032: second translation driving member; 7033: second translation member; 704: lifting component; 7041: lifting driving member; 7042: lifting plate; 7043: lifting guide slide rail; 7044: lifting guide slide block; 705: supporting seat; 706: rotary roller.

DETAILED DESCRIPTION OF THE INVENTION

The specific implementation modes of the present invention are further described below in detail in combination with the accompanying drawings and embodiments. The embodiments below are used to illustrate the present invention, but are not intended to limit the scope of the present invention.

Figure 2:
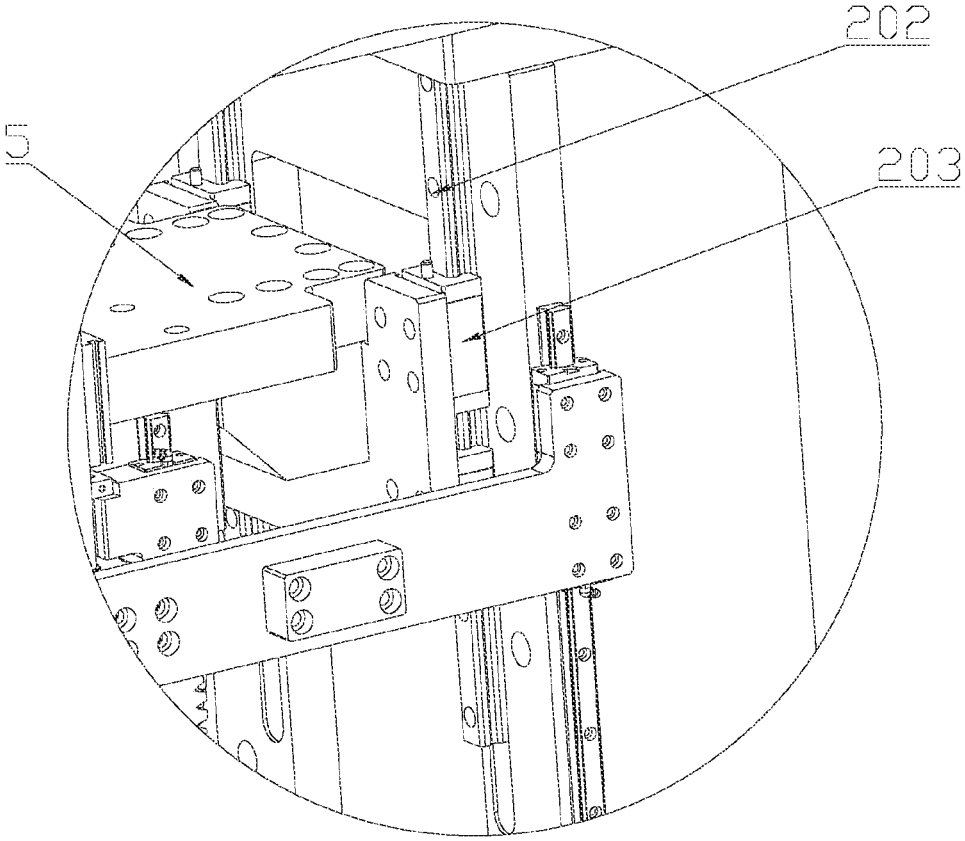
FIG. 2 is an enlarged diagram of part A in FIG. 1.
Figure 3:
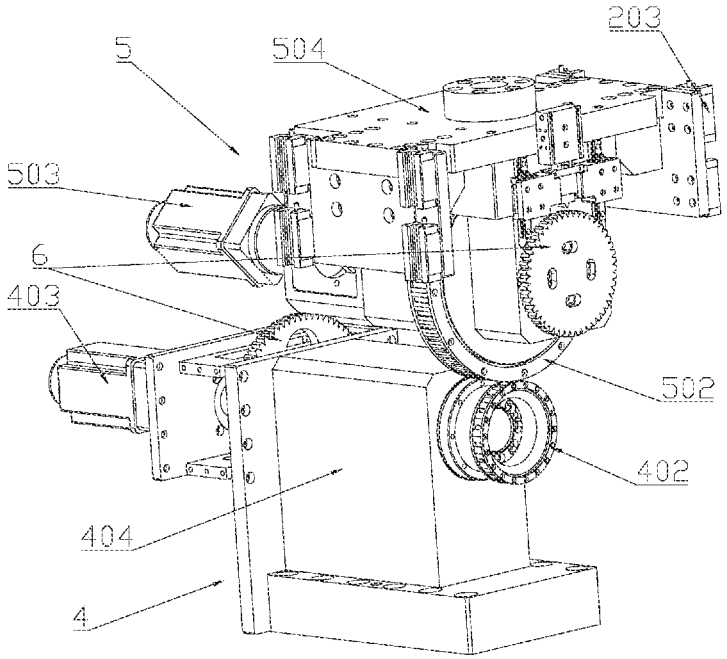
FIG. 3 is a schematic structural diagram of a first beer barrel printing device and a second beer barrel printing device in beer barrel printing equipment of the present invention.
Figure 4:
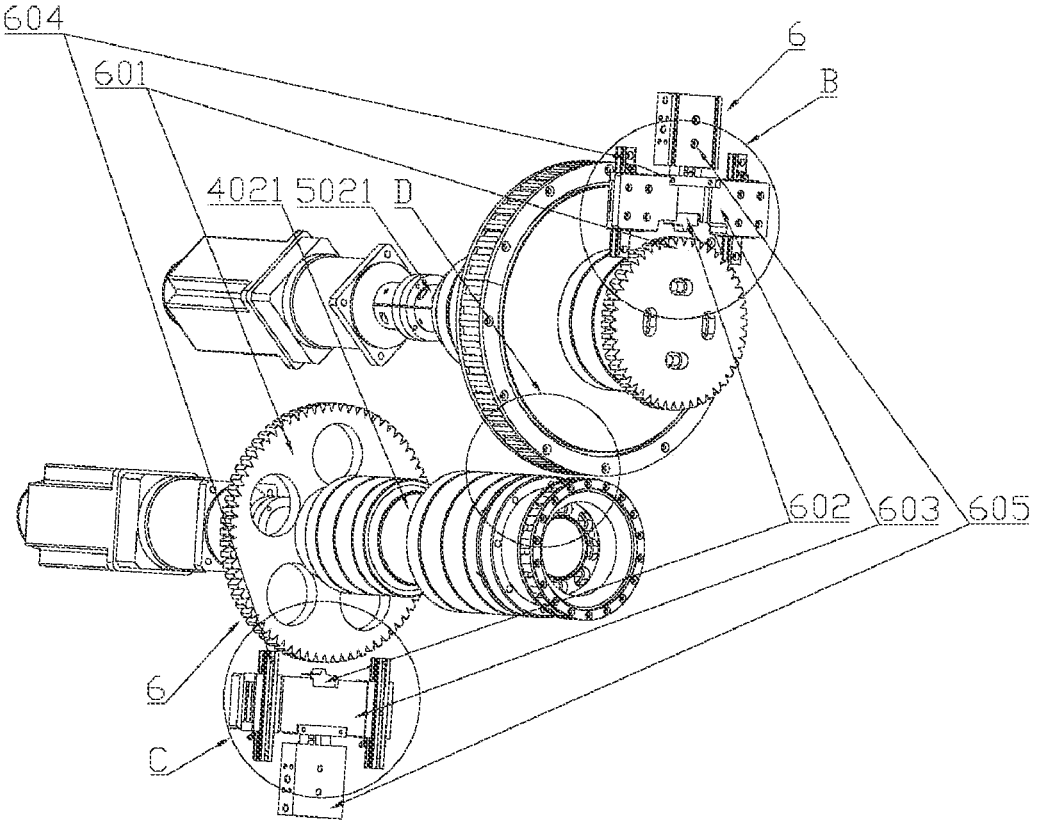
FIG. 4 is a primary schematic structural diagram of a first beer barrel printing device, a second beer barrel printing device and a locating component of beer barrel printing equipment of the present invention.
Figure 5:
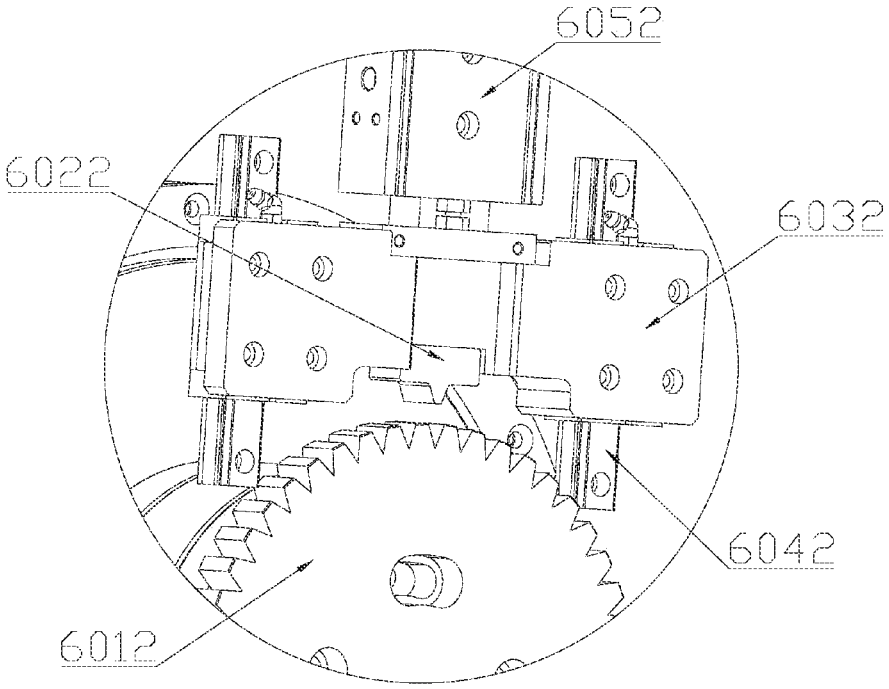
FIG. 5 is an enlarged diagram of part B in FIG. 4.
Figure 6:
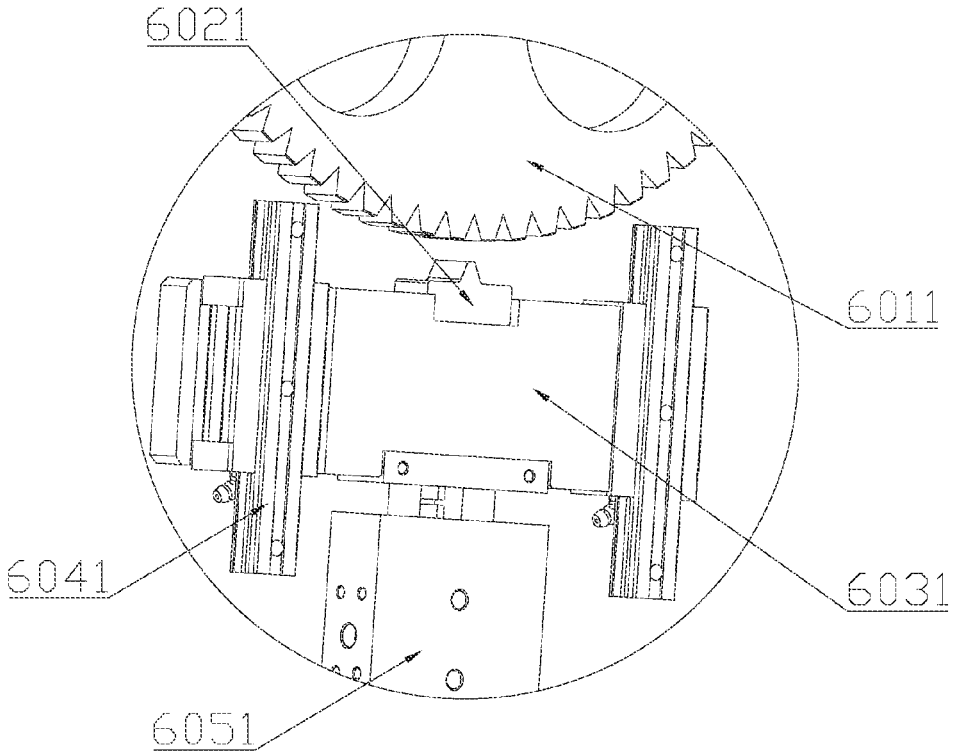
FIG. 6 is an enlarged diagram of part C in FIG. 4.
Figure 7:
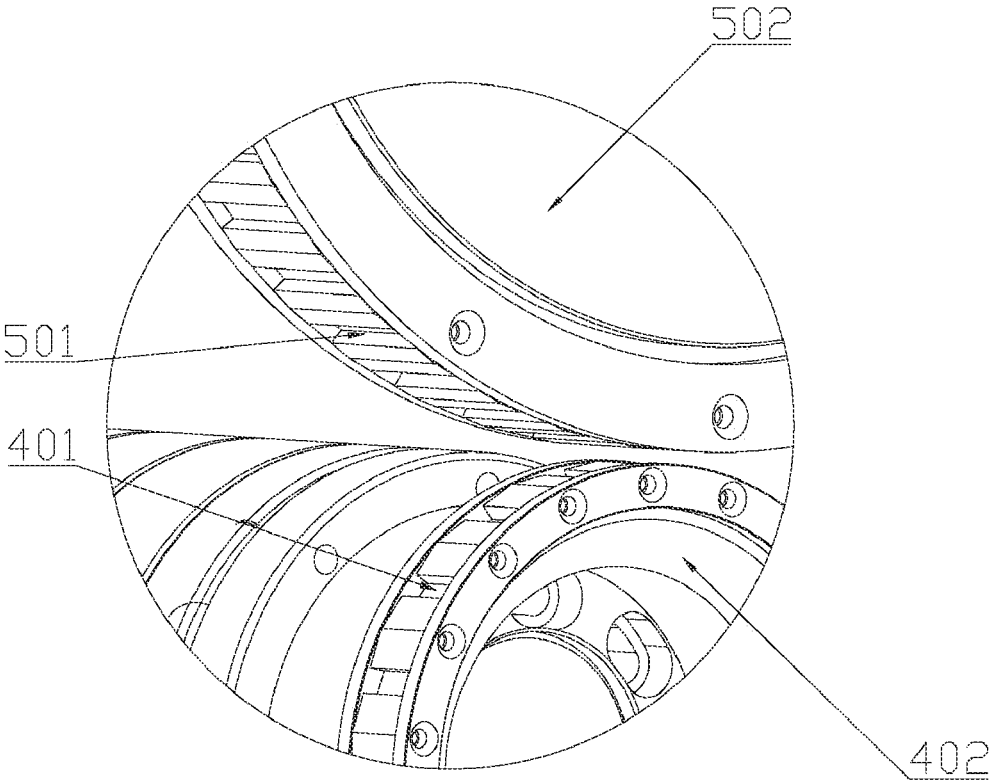
FIG. 7 is an enlarged diagram of part D in FIG. 4.
Figure 8:
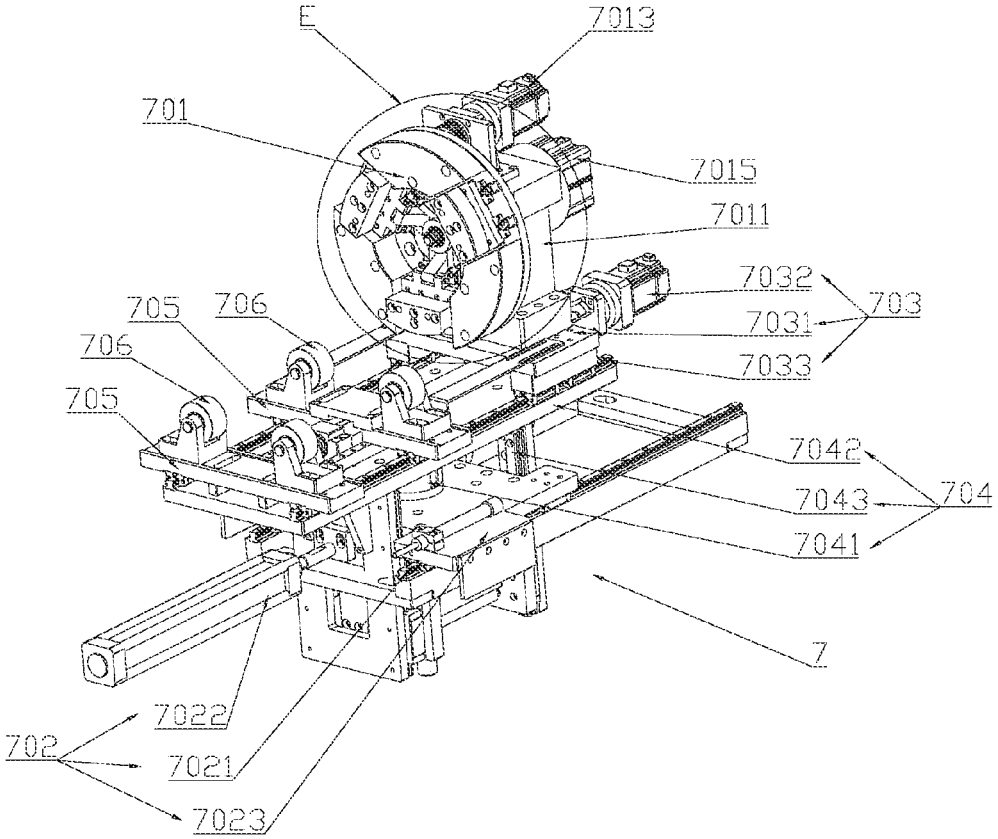
FIG. 8 is a schematic structural diagram of a beer barrel driving device of beer barrel printing equipment of the present invention.
Figure 9:
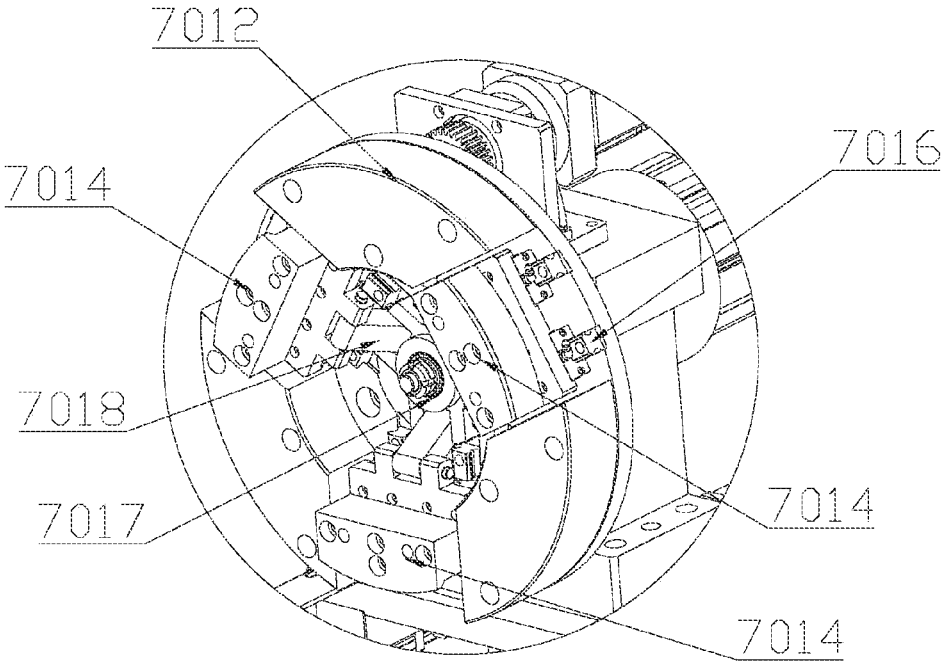
FIG. 9 is an enlarged diagram of part E in FIG. 8.
Figure 10:
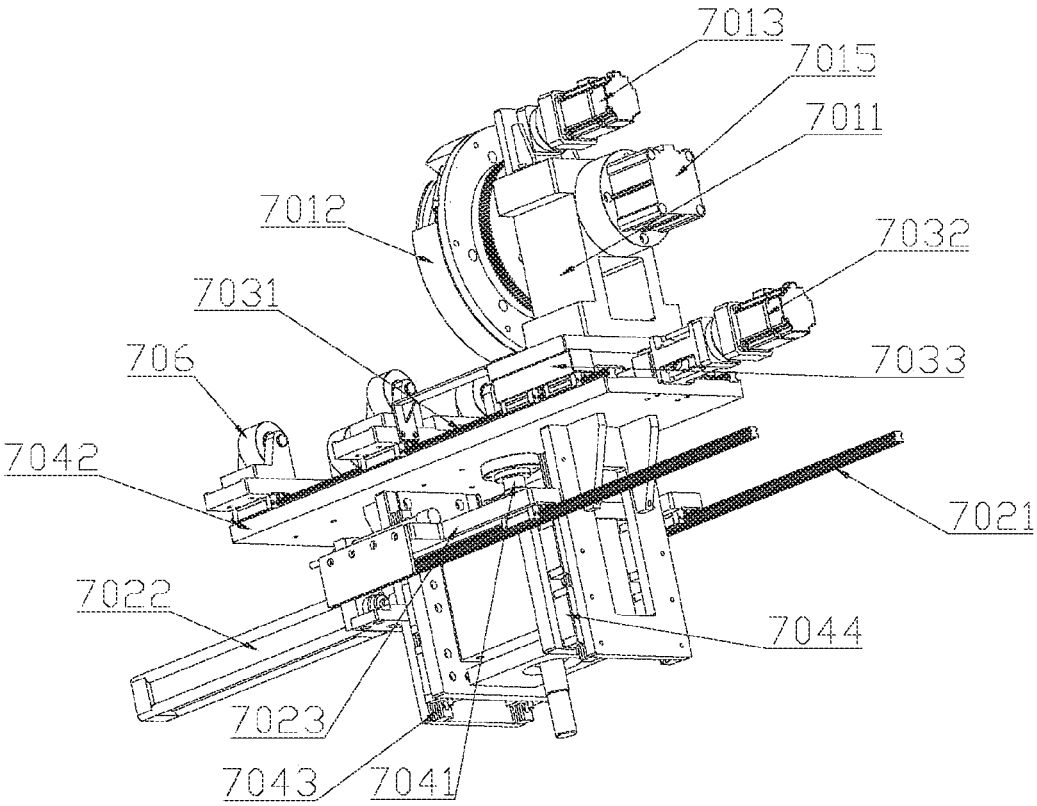
FIG. 10 is a schematic structural diagram of a beer barrel driving device of beer barrel printing equipment of the present invention from another angle.
Figure 11:
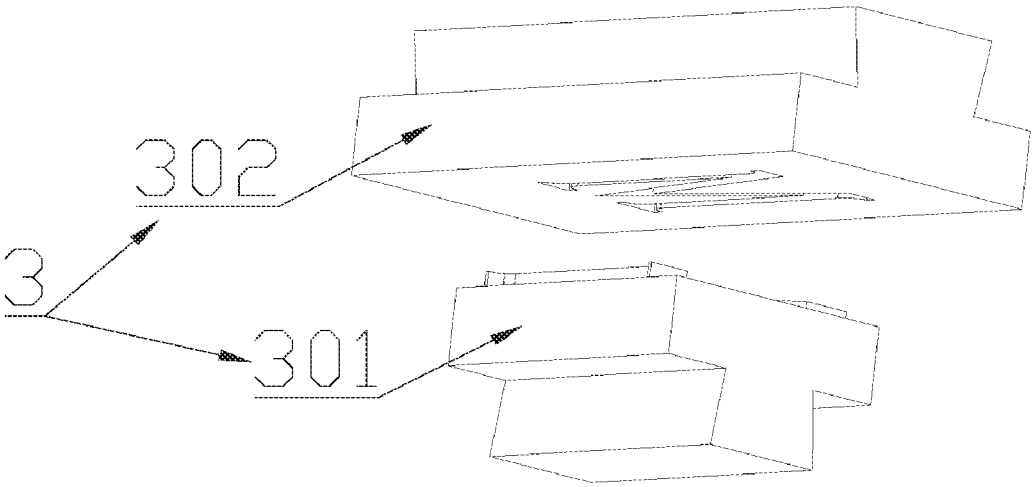
FIG. 11 is a schematic structural diagram of a matrix component in beer barrel printing equipment of the present invention.

As shown in FIG. 1 to FIG. 11, beer barrel printing equipment includes a stand 1, a pushing device 2, matrix components 3, a locating component 6, a first beer barrel printing device 4 mounted on the stand 1, and a second beer barrel printing device 5 mounted on the stand 1.

A plurality of the matrix components 3 are arranged, and each of the matrix components 3 includes a first matrix 301 and a second matrix 302 which cooperate with each other to imprint a single character or pattern; and the first matrix 301 and the second matrix 302 are located on two sides of a machining station for beer barrel printing.

A plurality of first matrix mounting positions 401 are distributed on the first beer barrel printing device 4; the first matrixes 301 are mounted on the first matrix mounting positions 401; the first beer barrel printing device 4 controls one of the first matrix mounting positions 401 to move to the machining station for beer barrel printing.

A plurality of second matrix mounting positions 501 are distributed on the second beer barrel printing device 5; the second matrixes 302 are mounted on the second matrix mounting positions 501; the second beer barrel printing device 5 controls one of the second matrix mounting positions 501 to move to the machining station for beer barrel printing.

The locating component 6 includes a locating gear 601, and a locating member 602 matched with the locating gear 601; the locating member 602 may be inserted into or separated from a tooth slot of the locating gear 601; in a state that the locating member 602 is inserted into the tooth slot of the locating gear 601, the first beer barrel printing device 4 is unable to control the first matrix mounting positions 401 to move and/or the second printing device is unable to control the second matrix mounting positions 501 to move.

The pushing device 2 is configured to control the first matrixes 301 and the second matrixes 302 to be close to each other or away from each other.

By the adoption of the above structure, a position of the beer barrel that needs to be printed is placed at the machining station for beer barrel printing; according to the imprinting content, the first beer barrel printing device 4 controls one of the first matrixes 301 that needs to be used to move to one side of the machining station for beer barrel printing, and the second beer barrel printing device 5 controls one of the second matrixes 302 that needs to be used to move to the other side of the machining station for beer barrel printing; at this time, the locating member 602 is inserted into the tooth slot of the locating gear 601, and if the first beer barrel is unable to control the first matrix mounting positions 401 to move, i.e., locking of the first matrixes 301 is realized, the used one of the first matrixes 301 is effectively prevented from skewing in the residual printing process to affect the printing effect; and if the second beer barrel is unable to control the second matrix mounting positions 501 to move, i.e., locking of the second matrixes 302 is realized, the used one of the second matrixes 302 is effectively prevented from skewing in the residual printing process to affect the printing effect.

The locating member 602 being inserted into the tooth slot of the locating gear 601 may also realize determining whether the used one of the first matrixes 301 and/or second matrixes 302 moves in place, i.e., whether the used one of the first matrixes 301 and/or second matrixes 302 directly faces the machining station for beer barrel printing; in some embodiments, when the locating member 602 is inserted into the tooth slot of the locating gear 601, the locating member 602 performs limiting adjustment on the locating gear 601 to affect the adjustment of motion control of the first beer barrel printing device 4 for the first matrix mounting positions 401 and/or the motion control of the second beer barrel printing device 5 for the second matrix mounting positions 501, so that the used one of the first matrixes 301 and/or second matrixes 302 directly faces the machining station for beer barrel printing to realize accurate locating.

The pushing device 2 controls the first matrixes 301 and the second matrixes 302 to be close to each other to realize printing on the beer barrel. After imprinting of one character is completed, the pushing device 2 drives the first matrixes 301 and the second matrixes 302 to be away from each other, and the locating member 602 is separated from the tooth slot of the locating gear 601 and reset.

In some embodiments, the first beer barrel printing device 4 includes a corresponding first connecting frame along a linear direction; the first matrixes 301 are arranged and distributed on the connecting frame; the first connecting frame may linearly move according to the imprinting content to cause one of the first matrixes 301 that needs to be used to move to the machining station for beer barrel printing; in some embodiments, the second beer barrel printing device 5 includes a corresponding second connecting frame along the linear direction; the second matrixes 302 are arranged and distributed on the connecting frame; and the second connecting frame may linearly move according to the imprinting content to cause one of the second matrixes 302 that needs to be used to move to the machining station for beer barrel printing.

Preferably, the locating gear 601 includes a first locating gear 6011 and a second locating gear 6012; the locating member 602 includes a first locating member 6021 matched with the first locating gear 6011, and a second locating member 6022 matched with the second locating gear 6012.

In some embodiments, the first beer barrel printing device 4 includes a first printing turntable 402 capable of rotating axially; the first matrix mounting positions 401 are distributed on an excircle surface of the first printing turntable 402; and in a state that the first locating member 6021 is inserted into the tooth slot of the first locating gear 6011, the first printing turntable 402 is unable to rotate.

In some embodiments, the second beer barrel printing device 5 includes a second printing turntable 502 capable of rotating axially; the second matrix mounting positions 501 are distributed on an excircle surface of the second printing turntable 502; and in a state that the second locating member 6022 is inserted into the tooth slot of the second locating gear 6012, the second printing turntable 502 is unable to rotate.

By the adoption of the above structure, the first locating gear 6011 and the first locating member 6021 cooperate with each other to realize locking of the first printing turntable 402, so as to realize locking of the first matrixes 301; and the second locating gear 6012 and the second locating member 6022 cooperate with each other to realize locking of the second printing turntable 502, so as to realize locking of the second matrixes 302.

Preferably, the number of the first matrix mounting positions 401 on the first printing turntable 402 matches the number of the tooth slots of the first locating gear 6011; and the number of the second matrix mounting positions 501 on the second printing turntable 502 matches the number of the tooth slots of the second locating gear 6012.

By the adoption of the above structure, it is ensured that for any one of the first matrix mounting positions 401 on the first printing turntable 402 and any one of the second matrix mounting positions 501 on the second printing turntable 502, when the first printing turntable 402 and the second printing turntable 502 rotate to the machining station for beer barrel printing respectively, the first locating member 6021 and the second locating member 6022 can be respectively inserted into the tooth slots of the first locating gear 6011 and the second locating gear 6012.

Preferably, the number of the first matrix mounting positions 401 on the first printing turntable 402 is equal to the number of the tooth slots of the first locating gear 6011; and the number of the second matrix mounting positions 501 on the second printing turntable 502 is equal to the number of the tooth slots of the second locating gear 6012.

By the adoption of the above structure, the first matrix mounting positions 401 on the first printing turntable 402 are in one-to-one correspondence with the tooth slots of the first locating gear 6011; and the second matrix mounting positions 501 on the second printing turntable 502 are in one-to-one correspondence with the tooth slots of the second locating gear 6012.

Preferably, in some embodiments, the number of the first matrix mounting positions 401 on the first printing turntable 402 is not equal to the number of the tooth slots of the first locating gear 6011, and a numerical relation between the first matrix mounting positions 401 on the first printing turntable 402 and the tooth slots of the first locating gear 6011 matches a rotation speed relation between the first printing turntable 402 and the first locating gear 6011; the number of the second matrix mounting positions 501 on the second printing turntable 502 is not equal to the number of the tooth slots of the second locating gear 6012, and a numerical relation between the second matrix mounting positions 501 on the second printing turntable 502 and the tooth slots of the second locating gear 6012 matches a rotation speed relation between the second printing turntable 502 and the second locating gear 6012.

For example, a rotation speed ratio of the first locating gear 6011 to the first printing turntable 402 is 2:1, i.e., when the first locating gear 6011 rotates one circle, the second printing turntable 502 rotates two circles, so that the first matrix mounting positions 401 on the first printing turntable 402 are divided into pairs, and the two first matrix mounting positions 401 in each pair are symmetrically distributed on two sides of the first printing turntable 402, while the number of the tooth slots of the first locating gear 6011 is equal to the number of pairs of first matrix mounting positions 401, i.e., one of the tooth slots of the first locating gear 6011 corresponds to one pair of first matrix mounting positions 401; during operation, when one first matrix mounting position from one pair of first matrix mounting positions 401 rotates to the machining station for beer barrel printing, the first locating member 6021 is inserted into the corresponding tooth slot in the first locating gear 6011; when the other first matrix mounting position from this pair of first matrix mounting positions 401 rotates to the machining station for beer barrel printing, i.e., when the first printing turntable 402 rotates half a circle, the first locating gear 6011 rotates one circle at this time, and the first locating member 6021 is just still inserted into the original tooth slot.

Preferably, the pushing device 2 includes a pushing driving member 201 mounted on the stand 1, and the pushing driving member 201 acts on the second beer barrel printing device 5 and drives the second beer barrel printing device 5 to be close to or away from the first beer barrel printing device 4.

The stand 1 is provided with first guide rails 202 on two sides with the second beer barrel printing device 5; correspondingly, two sides of the second beer barrel printing device 5 facing the first guide rails 202 are correspondingly provided with first moving members 203 matched with the first guide rails 202, and the second beer barrel printing device 5 is slidably mounted on the stand 1 by means of the first moving members 203 and the first guide rails 202.

By the adoption of the above structure, after the used pair of first matrix 301 and second matrix 302 is positioned, an inner wall of the position of the beer barrel that needs to be printed is attached to the first matrix 301, and the pushing driving member 201 drives the second beer barrel printing device 5 to be close to the first beer barrel printing device 4 to cause the second matrix 302 to be attached to an outer wall of the position of the beer barrel that needs to be printed to realize coining; and after the imprinting of one character is completed, the pushing driving member 201 drives the second beer barrel printing device 5 to be away from the first beer barrel printing device 4.

The pushing driving member 201 is a pushing hydraulic cylinder.

Preferably, the first beer barrel printing device 4 includes a first servo motor 403, and a first mounting frame 404 configured to mount the first printing turntable 402; the first mounting frame 404 is connected with the stand 1; the first printing turntable 402 is convexly provided with a first rotating shaft 4021 at an axis thereof; the first printing turntable 402 is rotatably mounted on the first mounting frame 404 through the first rotating shaft 4021; the first locating gear 6011 is mounted on the first rotating shaft 4021; and the first servo motor 403 drives the first printing turntable 402 and the first locating gear 6011 to synchronously rotate around an axis of the first rotating shaft 4021.

By the adoption of the above structure, the first servo motor 403 drives the first printing turntable 402 to control the position to realize initial locating of the first printing turntable 402, i.e., realize rotating one first matrix that needs to be used from the first matrixes 301 distributed on the first printing turntable 402 to the position of the beer barrel that needs to be printed.

The synchronous rotation of the first printing turntable 402 and the first locating gear 6011 can be understood as that the rotating speeds of the two are equal.

Specifically, one side of the first printing turntable 402 is convexly provided with the first rotating shaft 4021; one side of the first locating gear 6011 is convexly provided with a motor connecting portion for driving connection with the first servo motor 403 at a rotating shaft of the first locating gear; and the other side of the first locating gear 6011 is connected with the first rotating shaft 4021.

A bearing is arranged between the first rotating shaft 4021 and the first mounting frame 404.

Preferably, the second beer barrel printing device 5 includes a second servo motor 503, and a second mounting frame 504 configured to mount the second printing turntable 502; the second mounting frame 504 is connected with the stand 1; the second printing turntable 502 is convexly provided with a second rotating shaft 5021 at an axis thereof; the second printing turntable 502 is rotatably mounted on the second mounting frame 504 through the second rotating shaft 5021; the second locating gear 6012 is mounted on the second rotating shaft 5021; and the second servo motor 503 drives the second printing turntable 502 and the second locating gear 6012 to synchronously rotate around an axis of the second rotating shaft 5021.

By the adoption of the above structure, the second servo motor 503 drives the second printing turntable 502 to control the position to realize initial locating of the second printing turntable 502, i.e., realize rotating one second matrix that needs to be used from the second matrixes 302 distributed on the second printing turntable 502 to the position of the beer barrel that needs to be printed.

The synchronous rotation of the second printing turntable 502 and the second locating gear 6012 can be understood as that the rotating speeds of the two are equal.

Specifically, two sides of the second printing turntable 502 are convexly provided with second rotating shafts 5021; an output shaft of the second servo motor 503 is in driving connection with the second rotating shaft 5021 on one side of the second printing turntable 502; and the second locating gear 6012 is mounted on the second rotating shaft 5021 on the other side of the second printing turntable 502.

Bearings are arranged between the second rotating shafts 5021 and the second mounting frame 504.

The pushing device 2 is connected with the second mounting frame 504, and the first moving members 203 are mounted on the second mounting frame 504.

Preferably, the locating component 6 includes a locating moving member 603 configured to mount the locating member 602, a locating guide rail 604 configured to guide the locating moving member 603, and a locating driving member 605 configured to drive the locating moving member 603; and the locating driving member 605 drives the locating moving member 603 to slide along the locating guide rail 604.

Specifically, the locating moving member 603 includes a first locating moving member 6031 and a second locating moving member 6032; the locating guide rail 604 includes a first locating guide rail 6041 and a second locating guide rail 6042; and the locating driving member 605 includes a first locating driving member 6051605 and a second locating driving member 6052605.

The first locating member 6021 is mounted on the first locating moving member 6031, and the first locating driving member 6051605 drives the first locating moving member 6031 to slide along the first locating guide rail 6041.

The first locating guide rail 6041 and the first locating driving member 6051605 are mounted on the first mounting frame 404.

The first locating driving member 6051605 and the first locating member 6021 are located on two sides of the first locating moving member 6031; and the shape of one end of the first locating member 6021 inserted into the tooth slot of the first locating gear 6011 matches the shape of the tooth slot of the first locating gear 6011.

The second locating member 6022 is mounted on the second locating moving member 6032, and the second locating driving member 6052605 drives the second locating moving member 6032 to slide along the second locating guide rail 6042.

The second locating guide rail 6042 and the second locating driving member 6052605 are mounted on the second mounting frame 504.

The second locating driving member 6052605 and the second locating member 6022 are located on two sides of the second locating moving member 6032; and the shape of one end of the second locating member 6022 inserted into the tooth slot of the second locating gear 6012 matches the shape of the tooth slot of the second locating gear 6012.

Preferably, the beer barrel printing equipment includes a beer barrel driving device 7. The beer barrel driving device 7 includes a beer barrel rotation component 701 configured to drive the beer barrel to axially rotate.

In actual production, a string of characters need to be imprinted on a side wall of the beer barrel. By the adoption of the above structure, after the imprinting of one character is completed, the beer barrel driving device 7 rotates the beer barrel to cause a next position of the beer barrel that needs to be printed to rotate to the machining station for beer barrel printing for imprinting.

Preferably, the beer barrel driving device 7 further includes a first translation component 702 and a second translation component 703 configured to drive the beer barrel rotation component 701 to be close to or away from one side provided with the first beer barrel printing device 4 and the second beer barrel printing device 5, and a lifting component 704 configured to drive the beer barrel rotation component 701 to rise and fall.

By the adoption of the above structure, the first translation component 702 is configured to realize that the beer barrel to be machined fast gets close to or away from the first beer barrel printing device 4 and the second beer barrel printing device 5 to realize initial locating of the beer barrel, and the second translation component 703 is configured to realize accurate locating of the beer barrel to be machined.

The lifting component is configured to drive an inner wall of the beer barrel to be machined to be attached to and separated from the second matrixes 302.

Preferably, the first translation component 702 includes a first translation guide rail 7021 arranged on the stand 1, a first translation driving member 7022, and a first translation member 7023; the first translation driving member 7022 drives the first translation member 7023 to translate along the first translation guide rail 7021.

The lifting component 704 includes a lifting driving member 7041 and a lifting plate 7042; the lifting driving member 7041 is mounted on a second moving member, and the lifting driving member 7041 drives the lifting plate 7042 to rise and fall relative to the first moving members 203; the lifting component 704 further includes a lifting guide slide rail 7043 arranged on the lifting plate 7042 along a lifting direction of the lifting plate 7042, and a lifting guide slide block 7044 arranged on the second moving member along the lifting direction of the lifting plate 7042; and the lifting guide slide rail 7043 matches with the lifting guide slide block 7044 to slide.

The second translation component 703 includes a second translation guide rail 7022 arranged on the lifting plate 7042, a second translation driving member 7032 and a second translation member 7033; the second translation driving member 7032 drives the second translation member 7033 to translate along the second translation guide rail 7022; and the beer barrel rotation component 701 is mounted on the second moving member.

Specifically, the first translation driving member 7022 and the lifting driving member 7041 adopt cylinders, and the second translation driving member 7032 adopts a screw rod.

Preferably, the beer barrel rotation component 701 includes a clamping jaw mounting frame 7011, a clamping jaw disc 7012 rotatably mounted on the clamping jaw mounting frame 7011, and a clamping jaw disc driving member 7013 configured to drive the clamping jaw disc 7012 to rotate; and a plurality of clamping jaws 7014 configured to fix the beer barrel are mounted on the clamping jaw disc 7012.

By the adoption of the above structure, the clamping jaws 7014 on the clamping jaw disc 7012 grasp the beer barrel, and the axis of the beer barrel is coaxial with the axis of the clamping jaw disc; the clamping jaw driving member 7015 drives the clamping jaw disc 7012 to rotate, and the beer barrel rotates with the rotation of the clamping jaw disc 7012.

Specifically, the clamping jaw mounting frame 7011 is mounted on the second translation member 7033; the clamping jaw disc 7012 is coaxially fixed with a clamping jaw disc drive gear; the clamping jaw disc driving member realizes rotation driving for the clamping jaw disc by means of the arrangement of a clamping jaw disc driven gear meshed with the clamping jaw disc drive gear.

Preferably, the clamping jaws 7014 may be slidably mounted on the clamping jaw disc close to or away from the center of the clamping jaw disc 7012, and the beer barrel rotation component 701 further includes a clamping jaw driving member 7015 configured to drive the clamping jaws 7014 to rotate.

By the adoption of the above structure, the clamping jaws 7014 firstly slide towards the center of the clamping jaw disc 7012 and extend into one end of the beer barrel; the clamping jaws 7014 then slide away from the center of the clamping jaw disc 7012, so that the clamping jaws 7014 support the inner wall of one end of the beer barrel to realize connection between the beer barrel and the clamping jaws 7014; and after all characters are imprinted, the clamping jaws 7014 slide towards the center of the clamping jaw disc 7012, so that the clamping jaws 7014 are separated from the beer barrel.

Specifically, three clamping jaws 7014 are provided; clamping jaw guide rails 7016 matched with the clamping jaws 7014 are arranged on the clamping jaw disc 7012; and the clamping jaws 7014 are slidably mounted on the clamping jaw guide rails 7016.

The clamping jaw driving member 7015 is a telescopic member, a telescopic end of the telescopic member is provided with a clamping jaw action member 7017; clamping jaw connecting members 7018 are arranged between the clamping jaw action member 7017 and the clamping jaws 7014, and two ends of the clamping jaw connecting members 7018 are rotatably connected with the clamping jaws 7014 and the clamping jaw action member respectively; and the clamping jaw driving member 7015 is a telescopic cylinder.

By the adoption of the above structure, when the clamping jaw driving member 7015 extends and retracts to drive the clamping jaw action member 7017 to be close to a plane where the clamping jaws 7014 are located, the clamping jaw connecting members 7018 push the clamping jaws 7014 to slide away from the center of the clamping jaw disc; and when the clamping jaw driving member 7015 extends and retracts to drive the clamping jaw action member 7017 to be away from the plane where the clamping jaws 7014 are located, the clamping jaw connecting members 7018 pull the clamping jaws 7014 to slide towards the center of the clamping jaw disc.

The clamping jaw action member 7017 is mounted on the clamping jaw disc 7012, and the clamping jaw action member 7017 is coaxial with the clamping jaw disc 7012; rotating shafts are arranged between a telescopic rod of the clamping jaw driving member 7015 and the clamping jaw disc 7012 as well as the clamping jaw action member 7017. In the above structure, the clamping jaw action member 7017 and the clamping jaw disc 7012 rotate together, and the clamping jaw driving member 7015 does not affect the clamping jaw disc 7012 and the clamping jaw action member 7017 when driving the clamping jaw action member 7017 to be close to or away from the mounting plane of the clamping jaws 7014.

Preferably, the beer barrel rotation component 701 includes supporting seats 705; rotary rollers 706 are mounted on the supporting seats 705; two supporting seats are arranged, and two rotary rollers 706 are symmetrically arranged on each of the supporting seats 705.

By the adoption of the above structure, the rotary rollers 706 are in contact with an outer wall of the beer barrel to support the beer barrel and reduce friction therebetween. Specifically, the supporting plates are slidably mounted on the second translation guide rail 7022; one of the supporting seats 705 close to the second translation member 7033 is connected with the second translation member 7033; and the two supporting seats 705 are connected through a connecting rod.

Preferably, the first matrixes 301 are located on the inner side of a side wall of the beer barrel to be machined, and the second matrixes 302 are located on the outer side of the side wall of the beer barrel to be machined; the first matrixes 301 are convex molds; and correspondingly, the second matrixes 302 are concave molds.

Preferably, the first matrix mounting positions 401 and the second matrix mounting positions 501 are provided with mounting slots; and the first matrixes 301 and the second matrixes 302 are respectively clamped in the mounting slots in the first matrix mounting positions 401 and the second matrix mounting positions 501 in a matching manner. Specifically, the mounting slots are dovetail slots.

The above is only the preferred implementation mode of the present invention. It should be noted that those of ordinary skill in the art can further make several improvements and retouches without departing from the technical principles of the present invention. These improvements and retouches shall also all fall within the protection scope of the present invention.

What is claimed is:

1. Beer barrel printing equipment, wherein the beer barrel printing equipment comprises a stand (1), a pushing device (2), matrix components (3), a locating component (6), a first beer barrel printing device (4) mounted on the stand (1), and a second beer barrel printing device (5) mounted on the stand (1);

a plurality of matrix components (3) are arranged, and each of the matrix components (3) comprises a first matrix (301) and a second matrix (302) cooperating with each other to imprint a single character or pattern; and the first matrix (301) and the second matrix (302) are located on two sides of a machining station for beer barrel printing;

a plurality of first matrix mounting positions (401) are distributed on the first beer barrel printing device (4); the first matrixes (301) are mounted on the first matrix mounting positions (401); the first beer barrel printing device (4) controls one of the first matrix mounting positions (401) to move to the machining station for beer barrel printing;

a plurality of second matrix mounting positions (501) are distributed on the second beer barrel printing device (5); the second matrixes (302) are mounted on the second matrix mounting positions (501); the second beer barrel printing device (5) controls one of the second matrix mounting positions (501) to move to the machining station for beer barrel printing;

the locating component (6) comprises a locating gear (601), and a locating member (602) matched with the locating gear (601); the locating member (602) may be inserted into or separated from a tooth slot of the locating gear (601); in a state that the locating member (602) is inserted into the tooth slot of the locating gear (601), the first beer barrel printing device (4) is unable to control the first matrix mounting positions (401) to move and/or the second printing device is unable to control the second matrix mounting positions (501) to move; and the pushing device (2) is configured to control the first matrixes (301) and the second matrixes (302) to be close to each other or away from each other.

2. The beer barrel printing equipment according to claim 1, wherein the locating gear (601) comprises a first locating gear (6011) and a second locating gear (6012); the locating member (602) comprises a first locating member (6021) matched with the first locating gear (6011), and a second locating member (6022) matched with the second locating gear (6012);

the first beer barrel printing device (4) comprises a first printing turntable (402) capable of rotating axially; the first matrix mounting positions (401) are distributed on an excircle surface of the first printing turntable (402); and in a state that the first locating member (6021) is inserted into the tooth slot of the first locating gear (6011), the first printing turntable (402) is unable to rotate; and the second beer barrel printing device (5) comprises a second printing turntable (502) capable of rotating axially; the second matrix mounting positions (501) are distributed on an excircle surface of the second printing turntable (502); and in a state that the second locating member (6022) is inserted into the tooth slot of the second locating gear (6012), the second printing turntable (502) is unable to rotate.

3. The beer barrel printing equipment according to claim 2, wherein the number of the first matrix mounting positions (401) on the first printing turntable (402) is equal to the number of the tooth slots of the first locating gear (6011); and the number of the second matrix mounting positions (501) on the second printing turntable (502) is equal to the number of the tooth slots of the second locating gear (6012).

4. The beer barrel printing equipment according to claim 1, wherein the pushing device (2) comprises a pushing driving member (201) mounted on the stand (1), and the pushing driving member (201) acts on the second beer barrel printing device (5) and drives the second beer barrel printing device (5) to be close to or away from the first beer barrel printing device (4); and the stand (1) is provided with first guide rails (202) on two sides with the second beer barrel printing device (5); correspondingly, two sides of the second beer barrel printing device (5) facing the first guide rails (202) are correspondingly provided with first moving members (203) matched with the first guide rails (202), and the second beer barrel printing device (5) is slidably mounted on the stand (1) by means of the first moving members (203) and the first guide rails (202).

5. The beer barrel printing equipment according to claim 2, wherein the first beer barrel printing device (4) comprises a first servo motor (403), and a first mounting frame (404) configured to mount the first printing turntable (402); the first mounting frame (404) is connected with the stand (1); the first printing turntable (402) is convexly provided with a first rotating shaft (4021) at an axis thereof; the first printing turntable (402) is rotatably mounted on the first mounting frame (404) through the first rotating shaft (4021); the first locating gear (6011) is mounted on the first rotating shaft (4021); the first servo motor (403) drives the first printing turntable (402) and the first locating gear (6011) to synchronously rotate around an axis of the first rotating shaft (4021); and the second beer barrel printing device (5) comprises a second servo motor (503), and a second mounting frame (504) configured to mount the second printing turntable (502); the second mounting frame (504) is connected with the stand (1); the second printing turntable (502) is convexly provided with a second rotating shaft (5021) at an axis thereof; the second printing turntable (502) is rotatably mounted on the second mounting frame (504) through the second rotating shaft (5021); the second locating gear (6012) is mounted on the second rotating shaft (5021); and the second servo motor (503) drives the second printing turntable (502) and the second locating gear (6012) to synchronously rotate around an axis of the second rotating shaft (5021).

6. The beer barrel printing equipment according to claim 1, wherein the locating component (6) comprises a locating moving member (603) configured to mount the locating member (602), a locating guide rail (604) configured to guide the locating moving member (603), and a locating driving member (605) configured to drive the locating moving member (603); and the locating driving member (605) drives the locating moving member (603) to slide along the locating guide rail (604).

7. The beer barrel printing equipment according to claim 1, wherein the beer barrel printing equipment comprises a beer barrel driving device (7), and the beer barrel driving device (7) comprises a beer barrel rotation component (701) configured to drive a beer barrel to axially rotate; and the beer barrel driving device (7) further comprises a first translation component (702) and a second translation component (703) configured to drive the beer barrel rotation component (701) to be close to or away from one side provided with the first beer barrel printing device (4) and the second beer barrel printing device (5), and a lifting component (704) configured to drive the beer barrel rotation component (701) to rise and fall.

8. The beer barrel printing equipment according to claim 7, wherein the first translation component (702) comprises a first translation guide rail (7021) arranged on the stand (1), a first translation driving member (7022) and a first translation member (7023); the first translation driving member (7022) drives the first translation member (7023) to translate along the first translation guide rail (7021);

the lifting component (704) comprises a lifting driving member (7041) and a lifting plate (7042); the lifting driving member (7041) is mounted on a second moving member, and the lifting driving member (7041) drives the lifting plate (7042) to rise and fall relative to the first moving members (203); the lifting component (704) further comprises a lifting guide slide rail (7043) arranged on the lifting plate (7042) along a lifting direction of the lifting plate (7042), and a lifting guide slide block (7044) arranged on the second moving member along the lifting direction of the lifting plate (7042); the lifting guide slide rail (7043) matches with the lifting guide slide block (7044) to slide; and the second translation component (703) comprises a second translation guide rail (7022) arranged on the lifting plate (7042), a second translation driving member (7032) and a second translation member (7033); the second translation driving member (7032) drives the second translation member (7033) to translate along the second translation guide rail (7022); and the beer barrel rotation component (701) is mounted on the second moving member.

9. The beer barrel printing equipment according to claim 7, wherein the beer barrel rotation component (701) comprises a clamping jaw mounting frame (7011), a clamping jaw disc (7012) rotatably mounted on the clamping jaw mounting frame (7011), and a clamping jaw disc driving member (7013) configured to drive the clamping jaw disc (7012) to rotate; a plurality of clamping jaws (7014) configured to grasp the beer barrel are mounted on the clamping jaw disc (7012); and the clamping jaws (7014) may be slidably mounted on the clamping jaw disc (7012) close to or away from a center of the clamping jaw disc, and the beer barrel rotation component (701) further comprises a clamping jaw driving member (7015) configured to drive the clamping jaws (7014) to rotate.

10. The beer barrel printing equipment according to claim 1, wherein the first matrixes (301) are located on an inner side of a side wall of the beer barrel to be machined, and the second matrixes (302) are located on an outer side of the side wall of the beer barrel to be machined; the first matrixes (301) are convex molds; and correspondingly, the second matrixes (302) are concave molds.

* * * * *